United States Patent [19]

Norris

[11] 4,299,195

[45] Nov. 10, 1981

[54] ARROW REST ASSEMBLY

[76] Inventor: John P. Norris, 2160 San Antonio Ave., Alameda, Calif. 94501

[21] Appl. No.: 686,232

[22] Filed: May 13, 1976

Related U.S. Application Data

[63] Continuation of Ser. No. 534,208, Dec. 19, 1974, abandoned.

[51] Int. Cl.[3] ..... F41B 5/00

[52] U.S. Cl. ..... 124/24 R; 124/41 A

[58] Field of Search ..... 124/41 A, 24 R, 36

[56] References Cited

U.S. PATENT DOCUMENTS

| | | | |
|---|---|---|---|
| 3,285,237 | 11/1966 | Wolfe | 124/41 A |
| 3,292,607 | 12/1966 | Hoyt | 124/41 A |
| 3,494,347 | 2/1970 | Saunders | 124/24 R |
| 3,865,096 | 2/1975 | Troncoso | 124/24 R |
| 3,919,997 | 11/1975 | Day | 124/41 A |
| 3,935,854 | 2/1976 | Troncoso | 124/41 A X |

*Primary Examiner*—Richard T. Stouffer
*Assistant Examiner*—William R. Browne
*Attorney, Agent, or Firm*—Edward Brosler; Merwyn Brosler

[57] ABSTRACT

An arrow rest assembly including a coil spring or equivalent having multi-directional flexibility including flexibility in various planes serves to more effectively dampen oscillations set up in an arrow when released from a bow.

4 Claims, 3 Drawing Figures

ARROW REST ASSEMBLY

This is a continuation of application Ser. No. 534,208, filed Dec. 19, 1974, now abandoned.

The invention relates to archery, and more particularly, to an arrow rest assembly for supporting the forward or head end of an arrow preparatory to shooting it from a bow.

Known to the field of archery is a phenomemnon known as the archer's paradox. It relates to lateral oscillation set up in an arrow at the moment of release from a bow, such phenomenon being attributable to the fact that the forward or head end of an arrow tends to remain at rest the instant the arrow is released, causing a lateral flexing of the arrow which results in oscillations of the arrow in flight. Such oscillations can adversely affect accuracy.

Arrow rest assemblies have been developed in the past in the apparent hope of damping such oscillations, but with only partial success. An analysis of these prior assemblies bring out the fact that, either due to a lack of complete understanding of the phenomenon that causes such oscillations, or an inability to work out a proper solution, the known rest assemblies were either too stiff or exhibited flexibility in but a limited plane.

Among the objects of the present invention are

1. To provide a novel and improved arrow rest assembly;
2. To provide a novel and improved arrow rest assembly which will serve to damp oscillations in various planes;
3. To provide a novel and improved arrow rest assembly which is simple in design, but effective in accomplishing its purpose.

Figure 1:
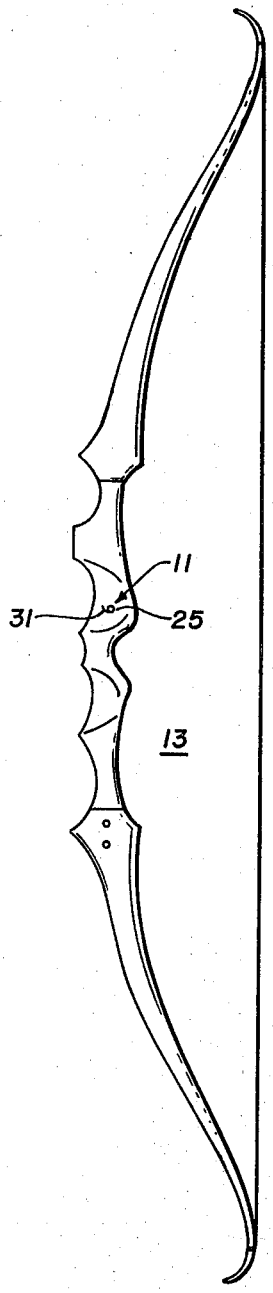
Figure 2:
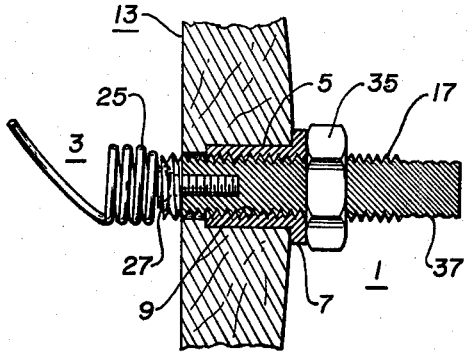
Figure 3:
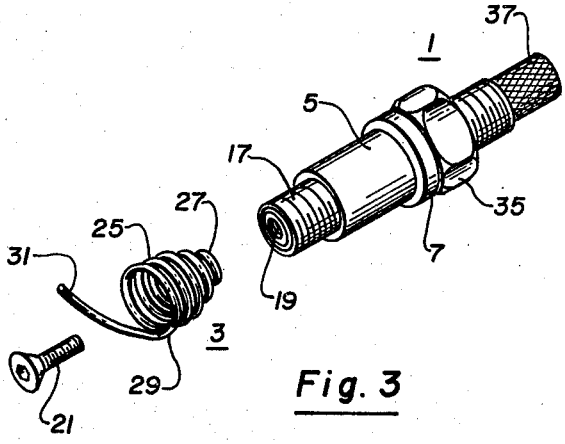

Additional objects of the invention will be brought out in the following description of a preferred embodiment of the same, taken in conjunction with the accompanying drawings, wherein, FIG. 1 is a view in elevation of the bow depicting an arrow rest assembly of the present invention installed thereon;

FIG. 2 is a view, in section, taken through the arrow rest assembly of FIG. 1, as installed in the bow; and FIG. 3 is an exploded view of the arrow rest assembly of FIG. 2.

The present invention is predicated on the recognition that the oscillations of an arrow set in flight from a bow, may vary with a number of circumstances such as the idiosyncrasies of the archer, the physical characteristics of the bow, and even characteristics peculiar to the specific arrow itself; and the plane of oscillation may thus be indefinite, in that the arrow might be forced to oscillate in more than one plane simultaneously.

The arrow rest assembly in accordance with the present invention, accordingly, is so designed as to be flexible in a plurality of planes, and preferably, in all planes, so as to have the capability of damping oscillations of an arrow regardless of the plane or planes in which such oscillations may be set up, upon release of an arrow from a bow.

Referring to the drawings for details of the invention in its preferred form, the arrow rest assembly comprises a rest support means 1 adapted for installation on a bow in proximity to the point of rest of an arrow to be shot from said bow, and an arrow rest 3 having multidirectional flexibility, affixed to the rest support means in the normal rest position for an arrow to be shot from such bow.

The rest support means involves a ferrule 5 having a flange 7 at one end and a longitudinal threaded passageway 9, and ferrule being adapted for installation at the appropriate point 11 in a bow 13 by snugly fitting the ferrule into an opening formed through the bow. The ferrule threadedly receives a stem 17 of a length preferably exceeding the thickness of the bow at the point of installation, to enable exposure of the forward end of the stem, which is preferably provided with a threaded recess 19 to receive a mounting screw 21 for affixing the rest to the support.

The arrow rest, itself, is preferably in the form of a coil spring 25 having at its mounting end a tight turn 27 of a diameter smaller than the head of the mounting screw, while at its other end, the end turn 29 terminates in a terminal portion 31 extending in a generally longitudinal direction to provide support for the forward end portion of an arrow preparatory to its release in flight from a bow.

Of considerably significance to the present invention, is the fact that the coil spring and its manner of mounting, provides flexibility not only in all directions normal to the longitudinal axis thereof, but also along its longitudinal axis, and permits flexing simultaneously in a plurality of planes or directions. Thus, regardless of the plane or planes of oscillations set up in an arrow shot from the bow, the arrow rest can respond and function to damp such oscillations.

The threaded stem to which the arrow rest is assembled, being threadedly installed in the ferrule, enables adjustment of the spacing of the arrow rest from the proximate side of the bow, and to maintain it in such adjustment, a nut 35 is threaded onto the tail end of the stem and into engagement with the ferrule flange, whereby the stem will be locked in its prevailing position. To facilitate such adjustments of the stem, the initial portion 37 of the tail end of the stem may be knurled to provide adequate finger grip.

While the ferrule 5 has been shown inserted into the bow from the side opposite the arrow rest, it could just as well be inserted in the opposite side of the bow, in which case, the bow should preferably be recessed about the entrance to the ferrule opening to receive the flange 7 flush with the surface of the bow.

Since a heavy bow will impart greater oscillation force to an arrow than a bow of lighter weight, it is contemplated that the flexibility of the arrow rest will be varied accordingly as by utilizing springs of different gauge, whereby proper damping may be realized.

While the preferred form of the present invention has the arrow rest in the form of a coil spring, it will be appreciated that resilient material such as rubber, for example, may conceivably be utilized to provide the multidirectional flexibility. Other changes may occur without departing from the underlying principles involved in the present invention, and I, accordingly, do not desire to be limited in my protection to the specific details illustrated and described, except as may be necessitated by the appended claims.

I claim:

1. An arrow rest assembly comprising rest support means adapted for installation on a bow in proximity to the point of rest of an arrow to be shot from such bow, an arrow rest having multi-directional flexibility including flexibility in various planes, and means for affixing said arrow rest to said support means with said rest in the normal rest position for an arrow to be shot from such bow, said arrow rest support means including a ferrule adapted for installation transversely of a bow and having a threaded longitudinal passageway therethrough, a stem adjustably threaded through said passageway and having a threaded recess at one end, said arrow rest including a coil spring having a tight turn at one end and at its other end, a terminal portion of the end turn extended in a generally longitudinal direction, said spring providing an arrow rest having resiliency in various directions, and means for locking said stem in any of its adjustable positions.

2. An arrow rest assembly in accordance with claim 1, and a bow having said arrow rest assembly installed thereon with said multi-directional flexible arrow rest extending to one side of said bow at the point of rest of an arrow to be shot from said bow.

3. An arrow rest assembly comprising rest support means adapted for installation on a bow in proximity to the point of rest of an arrow to be shot from such bow, an arrow rest having multi-directional flexibility including flexibility in various planes, and means for affixing said arrow rest to said support means with said rest in the normal rest position for an arrow to be shot from such bow, said arrow rest including a coil spring, said means for affixing said arrow rest to said support means being connected to one end of said coil spring, said coil spring having a free end, said free end including an end turn having a terminal portion extending away from the plane of said end turn to provide a rest location for an arrow.

4. An arrow rest assembly in accordance with claim 3, and a bow having said arrow rest assembly installed thereon with said coil spring extending to one side of said bow at the point of rest of an arrow to be shot from said bow.

* * * * *